United States Patent [19]

Burkell et al.

[11] Patent Number: 4,702,805

[45] Date of Patent: Oct. 27, 1987

[54] PRODUCTION OF SODIUM CHLORATE

[75] Inventors: John E. Burkell, North Vancouver; Ian H. Warren, Vancouver, both of Canada

[73] Assignee: C-I-L Inc., North York, Canada

[21] Appl. No.: 844,628

[22] Filed: Mar. 27, 1986

[51] Int. Cl.[4] ..... C25B 1/26; C25B 1/34

[52] U.S. Cl. ..... 204/95; 23/302 T

[58] Field of Search ..... 204/95; 23/302 R, 302 T

[56] References Cited

U.S. PATENT DOCUMENTS

| | | | |
|---|---|---|---|
| 3,835,001 | 9/1974 | O'Brien | 204/95 |
| 3,883,406 | 5/1975 | O'Brien et al. | 204/95 |
| 4,072,472 | 2/1978 | Lukes | 23/302 T |
| 4,087,253 | 5/1978 | Zabotto et al. | 23/302 T |
| 4,547,197 | 10/1985 | Winkler | 23/302 T |
| 4,636,376 | 1/1987 | Maloney et al. | 204/95 |

FOREIGN PATENT DOCUMENTS

| | | | |
|---|---|---|---|
| 823187 | 9/1969 | Canada | 204/95 |

*Primary Examiner*—T. Tung

*Attorney, Agent, or Firm*—C. Brian Barlow

[57] ABSTRACT

Process for the production of sodium chlorate by the electrolysis of sodium chloride contaminated with sodium sulphate wherein the sulphate concentration in the system is kept below a pre-selected level. A portion of the mother liquor remaining after crystallizing out some of the sodium chlorate product is selectively further cooled to effect crystallization of some of the sodium sulphate present in the liquor. An acceptable "steady-state" concentration of sulphate ion is established which prevents the deleterious excess sulphate ion build-up in the electrolytic system.

7 Claims, 1 Drawing Figure

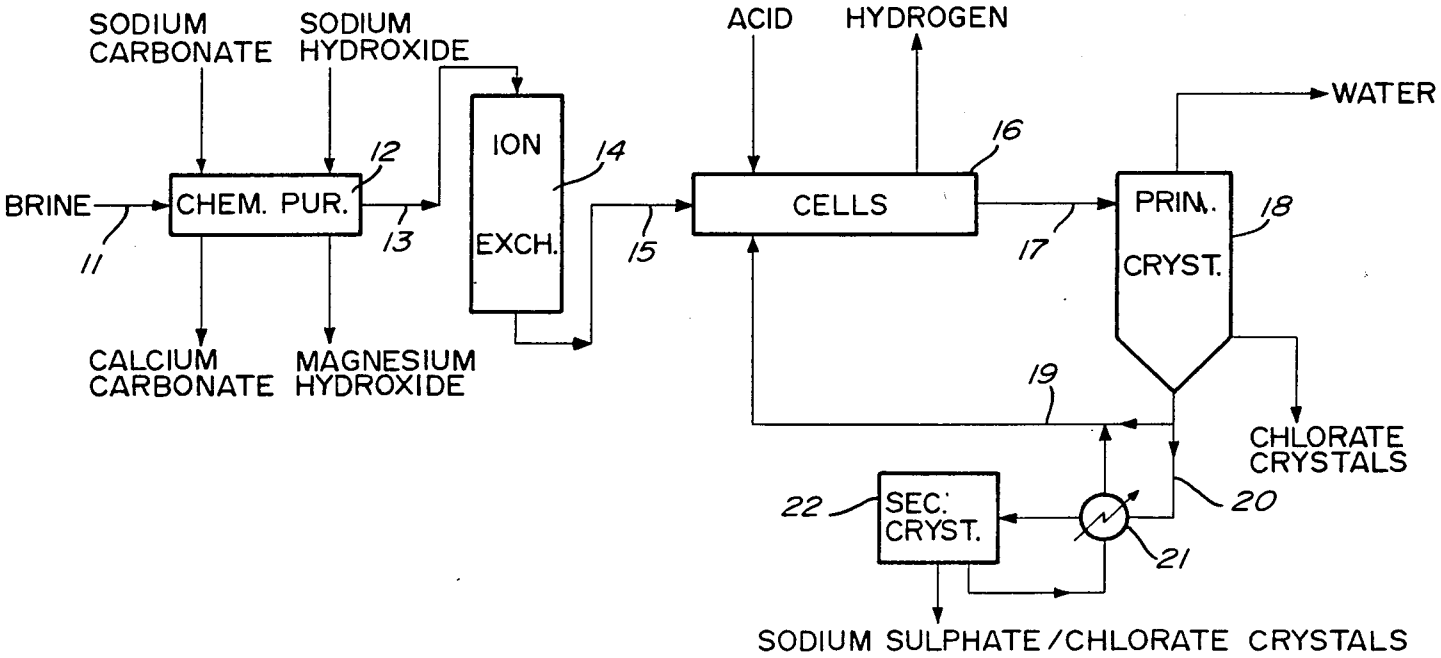
BRINE
11
SODIUM CARBONATE
SODIUM HYDROXIDE
CHEM. PUR.
12
13
CALCIUM CARBONATE
MAGNESIUM HYDROXIDE
ION EXCH.
14
15
ACID
HYDROGEN
CELLS
16
17
PRIM. CRYST.
18
WATER
19
CHLORATE CRYSTALS
20
21
SEC. CRYST.
22
SODIUM SULPHATE / CHLORATE CRYSTALS

PRODUCTION OF SODIUM CHLORATE

This invention relates to the manufacture of sodium chlorate by the electrolysis of an aqueous solution of sodium chloride and, particularly, to the manufacture of sodium chlorate from sodium chloride containing sulphate as an impurity.

Electrochemical apparatus and processes for the manufacture of sodium chlorate are well known and are widely employed for the industrial manufacture of that chemical. It is known to electrolyze brine to produce chlorine and sodium hydroxide and to make sodium hypochlorite therefrom within the electrolytic cell. It is also known that hypochlorite can be converted to chlorate and chloride ions according to the equation:

$$2HClO + O\ Cl^- \rightarrow ClO_3^- + 2H^+ + 2Cl^-$$

Thus, within the electrolytic system sodium chloride is, in effect, combined with water to form sodium chlorate and hydrogen gas. The electrolysis takes place, typically at 60°-90° C. in electrolytic cells comprising precious metal or metal oxide coated titanium anodes and steel cathodes, and with sodium dichromate being present in the liquor to improve the overall reaction efficiency. In the process, sodium chloride and water are introduced and a solution consisting of sodium chlorate, sodium chloride and sodium dichromate is produced.

It is not practical to electrolyze all the sodium chloride to sodium chlorate because of increased wear on the precious metal or metal oxide coating applied to the titanium anodes. Generally, the product liquor will contain a minimum of 100 gpl sodium chloride, with the sodium chlorate concentration ranging typically from 350 to 650 gpl sodium chlorate.

The sodium chloride salt used to prepare the brine for electrolysis to sodium chlorate is commonly rock salt or solar salt. Both these sources of salt contain impurities which are detrimental to the operation of the sodium chlorate cells. Typical of such impurities is calcium ion which when introduced into the electrolytic cell forms a deposit on the cathodes. This increases the electrical resistance of the cell and results in higher operating costs due to the consumption of additional electric energy. It is the normal practice to treat the brine before introduction to the electrolysis cells with sodium carbonate and sodium hydroxide to reduce the calcium content of the feed brine to levels below 10 ppm and concentration of magnesium to below 1 ppm.

Although the effects of calcium may be reduced by primary treatment of the brine with chemicals there remains some calcium in the brine which accumulates within the cell, resulting in an increase in electrolytic power consumption and thus an increase in operating costs. In recent years it has become more common to add, after the chemical treatment of the brine, a secondary purification using ion exchange resins developed for the removal of calcium and magnesium from brine solutions. Typical of such resins are Duolite ES467* and Rohm and Haas IRC718*. These resins remove calcium and magnesium to levels of less than 50 ppb, typically 25 ppb. This secondary purification process is particularly advantageous in areas of high electric power costs.

* Trade Mark

Sodium chlorate is the raw material used to produce chlorine dioxide gas of use when dissolved in water for the bleaching of pulp. When used for the production of chlorine dioxide the sodium chlorate is reacted commonly with sulphuric acid to produce chlorine dioxide, chlorine and sodium sulphate. Since sodium chlorate used for chlorine dioxide production is used in aqueous solution, the product liquor from electrolysis may therefore be used directly in chlorine dioxide generators. Manufacturing plants producing liquor as a product tend, however, to be close to the associated chlorine dioxide generator in order to minimize shipping costs associated with the transportation of significant quantities of water. This has the drawback, however, that sodium chlorate sold as liquor also contains the sodium dichromate which has been added to the cells to enhance the process efficiency. This sodium dichromate is lost to the producing plant and represents a significant production cost.

Merchant chlorate plants serving several customers distributed over a wide area typically produce sodium chlorate as crystal. In this way, shipping costs are minimized and sodium dichromate losses eliminated. The process to produce crystal sodium chlorate is conventional and well-known. Typically, the hot product liquor at 60°-90° C. containing sodium chlorate and sodium chloride is transferred to a vacuum crystallizer in which cooling occurs and water is evaporated resulting in crystallization of sodium chlorate. By suitable selection of the process operating conditions the sodium chloride may be kept in solution so that, after subsequent separation of the essentially pure crystal sodium chlorate from the mother liquor, the mother liquor may be recycled to the electrolytic cells. The crystal chlorate is typically dried and shipped, although in some operations the drying step is bypassed.

In addition to the calcium and magnesium impurities in the raw salt mentioned hereinabove sulphate ion is a common ingredient in commercial salt. When such salt is used directly or in the form of a brine solution and specific steps are not taken to remove the sulphate, the sulphate enters the electrolytic system.

Sulphate ion maintains its identity under the conditions in the electrolytic system and thus accumulates and progressively increases in concentration in the system unless removed in some manner. In sodium chlorate plants producing liquor product the sulphate ion will leave with the product liquor. However, plants producing only crystal sodium chlorate provide no outlet for this sulphate ion. The sulphate in the salt thus enters the electrolytic system and remains in the mother liquor after crystallization and is thus recycled to the cells. Over time the concentration of sulphate ion will increase. At sufficiently high sulphate concentration, sulphate adversely affects electrolytic power consumption and causes operating problems due to localized precipitation in the electrolytic cells. For example, at sulphate concentrations equivalent to a sodium sulphate concentration above 30 gpl, and depending on the electrolyte concentration and temperature, sulphate deposits will occur within the electrolytic cell restricting electrolyte circulation with serious detrimental consequences to cell power consumption and anode coating life. At typical operating conditions of the electrolytic cell and crystallizer, this effect within the cell occurs at a sulphate concentration lower than the saturation concentration in the crystallizer mother liquor. Thus the typical crystallizer does not serve to remove sulphate to a concentration acceptable to the electrolytic system. In practice, it is not possible to reduce the sulphate saturation concentration in the mother liquor from a vacuum crystallizer to an acceptable level because the solubility of sodium sulphate in mother liquor is essentially constant over the range of operating temperatures which can practically be achieved by vacuum cooling.

Several methods are presently employed to control sulphate concentrations in crystal chlorate plants, each with its attendant disadvantages.

It is possible to maintain sulphate in the system at an acceptable concentration by means of a liquor purge, that is, an export of chlorate solution. However, the minimum proportion of total production which must be exported as liquor is then fixed by the sulphate in the salt, not the market demand, which proportion can be large, depending on the sulphate concentration in the incoming salt or brine. Furthermore, this liquor product takes with it sodium dichromate, which represents an expense to replace, and a cost to remove if it is not acceptable in the liquid product. This method of operation requires a secure outlet for the sale of the liquor, which is of reduced economic value due to higher shipping costs. It also sets the upper limit on the proportion of the plant output which may be shipped as crystal.

An alternative method for controlling sulphate concentration is the reaction of the feed liquor to the crystallizer or mother liquor from the crystallizer, in whole or in part, with chemicals which form sulphate compounds that are relatively insoluble in the liquor. Typical examples are the reactions with barium chloride or barium carbonate, in order to form barium sulphate, and the reaction with calcium chloride to form calcium sulphate. In some cases the reaction with barium compounds is preferred, particularly, in those plants employing ion exchange treatment of the brine to prevent the introduction of calcium to the electrolytic cells. However, the process has several disadvantages.

A major disadvantage is that the addition of excessive quantities of barium compounds will result in excess barium entering the electrolytic cells. This barium forms a sulphate deposit on the anode coating that is deleterious to cell operation. In addition to the reaction with sulphate ion, the barium will also combine with chromate to form barium chromate and, thus, sufficient barium must be added to react with chromate as well as sulphate. Part of the value of the barium added is therefore lost. Barium compounds and sodium dichromate are expensive and this represents a significant waste of chemical reagents. The resulting barium sulphate and barium chromate sludge must be separated and the resulting solids disposed of. This represents a significant capital and operating cost.

Another disadvantage is that the reaction with calcium chloride produces calcium sulphate. This reaction requires the addition of more than stoichiometric quantities of calcium to the liquor to control the concentration of sulphate remaining in solution in the liquor. As previously described, calcium is deleterious to cell operation and this excess calcium must be removed, typically, by the addition of sodium carbonate, which precipitates calcium as calcium carbonate. However, not all calcium can be removed by this method as described previously under brine treatment, and the use of ion exchange resins to remove residual calcium from chlorate liquor has not been commercially established. This process therefore involves two reaction steps with each requiring separate solids separation. The separated solids must be disposed of.

Yet another disadvantage is that the solids produced by either barium or calcium treatment will be contaminated with chromium in the form of chromate or dichromate which is considered environmentally undesirable.

It is an object of the present invention to provide a process for the production of solid sodium chlorate from sodium chloride containing sulphate as an impurity with reduced detrimental effects by sulphate to cell power consumption.

It is a further object to provide an economical process for the removal of excess sulphate from a process for the production of sodium chlorate without the need for the addition of extraneous chemicals.

It is a still further object to provide an electrolytic process for the production of sodium chlorate without the loss of significant amounts of dichromate from the system.

Thus, it is an object of the present invention to provide an electrolytic process for the continuous production and removal of substantially pure solid sodium chlorate and such that the concentration of contaminant sulphate in the electrolytic system is not allowed to exceed a desired and selected limit. Pure sodium chlorate is obtained by selective crystallization from the aqueous circulatory system while the additional dual crystallization of sodium sulphate and sodium chlorate in admixture is effected from a minor portion of resultant mother liquor. The major portion of the resultant mother liquor and the spent minor portion are recycled back to the electrolytic cell.

Accordingly, the invention provides an improved continuous process for the production of sodium chlorate by the electrolysis of sodium chloride in an electrolytic process comprising:

(a) feeding water and sodium chloride contaminated with sulphate to a reaction zone wherein said sodium chloride is electrolyzed to chlorine and sodium hydroxide, said chlorine and sodium hydroxide is reacted to form sodium hypochlorite which is then reacted to produce a sodium chlorate rich liquor;

(b) cooling said sodium chlorate rich liquor to crystallize out a portion of said sodium chlorate to provide crystals of sodium chlorate and a mother liquor comprising sodium chlorate, sodium chloride and sulphate;

(c) removing said crystals of sodium chlorate; wherein the improvement comprises:

(d) recycling a major portion of said mother liquor to said reaction zone;

(e) cooling a minor portion of said mother liquor to a temperature to effect crystallization therefrom of a portion of said sulphate as sodium sulphate in admixture with said sodium chlorate, and production of a cold saturated solution of spent mother liquor;

(f) removing said crystallized admixture from said spent mother liquor;

(g) recycling said spent mother liquor to said reaction zone; and wherein the amount of said minor portion of said mother liquor is selected such that the sulphate concentration in said reaction zone is maintained substantially constant at a predetermined level.

The reaction zone may represent the electrolytic cells per se or further comprise a reactor tank to which the products of electrolysis, particularly, sodium hypochlorite are transferred and wherein chlorate-forming reactions occur from said products of electrolysis.

Electrolysis may be carried out in any suitable electrolytic cell equipped with a suitable anode and cathode. The cell may or may not be provided with a diaphragm or membrane disposed between the anode and cathode. In the absence of such a diaphragm or membrane chlorine produced at the anode is able to react with the caustic soda produced at the cathode to produce sodium chlorate. U.S. Pat. No. 3,732,153 illustrates an example of a preferred chlorate-type electrolytic cell for use in the present invention. However, electrolytic cells equipped with a diaphragm made of asbestos either alone or reinforced with resinous polymeric materials or membranes fabricated from cationic permselective materials, such as those available from E. I. DuPont under the trademark "Nafion" may also be used in the present invention. U.S. Pat. Nos. 3,464,901 and 3,897,320 disclose both diaphragm and membrane type chlor-alkali cells which may be used in the production of alkali metal chlorate according to the present invention.

It has been discovered that cooling of the mother liquor resulting from the selective crystallization of substantially pure sodium chlorate to temperatures below those considered normal for sodium chlorate vacuum crystallization causes a sudden decrease in sodium sulphate solubility. For instance, a solution containing 36% sodium chlorate, 9% sodium chloride and 2.1% sodium sulphate at 60° C. would be saturated with respect to sodium sulphate, and at temperatures down to approximately 10° C. the sodium sulphate solubility remains almost unchanged. However, at 5° C. or lower the sodium sulphate concentration for saturation has usefully fallen by a factor of approximately two to four to the range 1.25% to 0.4 to 0.5% sodium sulphate. It is also found that sodium chlorate solubility decreases and thus cooling the solution to −5° C. beneficially co-crystallizes sodium sulphate and sodium chlorate. Thus by removing a minor sidestream of the mother liquor and further chilling this sidestream an admixture of sodium sulphate and sodium chlorate crystals is obtained. These crystals may be separated and the spent mother liquor recycled. By selection of the flowrate of the minor sidestream to be chilled the sodium sulphate crystallized out from the system may be balanced with the sulphate entering the electrolytic system with the feed salt. For sulphate concentrations normally encountered in the feed salt the sidestream to be chilled represents a small fraction of the total mother liquor flow. The operating costs are, therefore, low and may be minimized by interchanging the heat in the sidestream feed to the chiller with the cold spent mother liquor leaving the chiller. The resulting sodium sulphate present in the admixture may not be disadvantageous as it is also a by-product of the chlorine dioxide producing process in which the sodium chlorate may be used.

It will be obvious to those skilled in the art that sulphate may be introduced into the chlorate process not only as a contaminant in the feed salt, but also as an impurity in the water fed into the process either directly or as a component of a brine feed solution, or by chemical reactions within the process, for example, by oxidation of sulphite to sulphate. It will also be obvious that the process of this invention will be equally effective in removing, and in controlling the concentration of, sulphate introduced by any of these sources.

Thus, it is possible by cooling to a suitable temperature to effect dual crystallization a relatively small and predetermined proportion of the crystallizer stream to crystallize sulphate at a rate equal to the rate of input of sulphate present as contaminant in the feed salt. A steady-state sulphate concentration is thus maintained in the electrolytic system at a level which is compatible with the entire process, including the electrolytic cells. Preferably the secondary crystallizer feed stream is the mother liquor from the main or primary flash or evaporative chlorate crystallizer.

Accordingly, in a preferred feature the invention provides a process as hereinbefore defined wherein said minor portion of mother liquor is cooled to a temperature in the region of about 5° C. or lower, and more preferably to ca. −5° C.

We have found that at temperatures in the region of −5° C. or lower, in chlorate/chloride liquors of compositions suitable to chlorate crystallizing processes employing flash or evaporative chlorate crystallizers, sodium sulphate will co-crystallize with sodium chlorate at a concentration which is well below the critical sulphate concentration for the electrolytic process. Sodium chlorate crystal can be produced in a predictable amount, along with the sodium sulphate solid, in the secondary chilled crystallizing step. However, this represents only a small fraction of the pure sodium chlorate crystal produced in the main crystallizer and can be readily handled. As a result, in an all-crystal continuous process, the equivalent amount to all of the incoming contaminant sulphate would appear in the admixture crystal product. The concentration of sulphate in the "primary" crystallizer crystal product will be very small relative to the ratio of sulphate to chlorate in the minimum liquor purge.

This process for removal of sulphate and control of sulphate concentration can readily be integrated with an existing chlorate crystallization system.

Sulphate could also be removed by operating the main crystallizer at a similarly low temperature, but this would require a much larger and less economical refrigeration duty, and would invariably require a crystallizer specifically designed for the purpose.

It can be readily seen by the skilled man in the art that the relative amounts of the minor and major portions of the mother liquor may be readily determined or selected depending on the desired value of steady-state sulphate concentration present in the electrolytic system. Clearly, to maintain a steady-state concentration of sulphate in the process the quantity of sulphate removed by secondary chilling must equal that entering the process with the salt. The higher the concentration of sulphate in the feed salt the greater the minor proportion of mother liquor subjected to secondary chilling. If it is desired to change the steady-state concentration of sulphate in the liquor then this may be achieved by temporarily increasing or decreasing the minor proportion of mother liquor, depending upon whether the sulphate concentration is to be reduced or increased. A balance is struck between the economic cost disadvantage involved in chilling the minor portion of mother liquor and the advantageous effect of reduced sulphate concentration in the electrolytic system in determining the amount of the minor sidestream.

The temperature to which the sodium chlorate rich liquor is subjected in the primary crystallizer may also be readily selected by the skilled man. Experience from conventional processes in plants employing flash or evaporative sodium chlorate crystallizers operating in the 18° C. to 40° C. range shows that sulphate concentration builds to the point where salting out of a sulphate compound occurs not within the crystallizer but within the electrolytic cell. However, cooling this liquor to at least temperatures within this 18° C. to 40° C. range in the process of the invention is advantageous in terms of economic cost.

In a further preferred feature the invention provides a process as hereinbefore defined wherein the concentration of sodium sulphate in the electrolytic system does not exceed 30 g/liter.

The make-up sodium chloride feed contaminated with sulphate is fed in an amount to provide sufficient sodium chloride for the electrolytic process while taking into account the resulting sulphate contaminant concentration in the liquor. It is a feature of the continuous process of the invention that the sulphate concentration is maintained substantially constant, and this is achieved by the addition of sufficient sodium chloride feed containing sulphate commensurate with the amount of sodium sulphate removed in the secondary chiller. The make-up contaminated sodium chloride may be added in the form of an aqueous solution or in solid form to the electrolytic system. It may be added to the cell directly, to a brine feed inlet, to the recycled spent mother liquor, or in any other appropriate manner to the reaction zone.

Accordingly, in a yet further feature, the invention provides a process as hereinbefore defined wherein said sodium chloride contaminated with sulphate is added to said reaction zone in the form of an aqueous solution.

In a still yet further feature, the invention provides a process as hereinbefore defined wherein the minor portion of said mother liquor is cooled to such temperature to effect said crystallization of a portion of said sulphate in admixture with said sodium chlorate that the concentration of sulphate remaining in said cold saturated spent mother liquor does not exceed 10 g/liter, preferably not greater than 7 g/liter, considered as sodium sulphate.

It will be readily seen that the option is available for the sodium sulphate-sodium chlorate admixture to be cleaned of contaminant sodium sulphate by the conventional chemical precipitation routes.

In a plant in which 0.5 tonnes/day of sulphate as sodium salt is introduced with the salt feed chemical precipitation with calcium or barium compounds may be used.

The reaction of calcium (as calcium chloride) with sodium sulphate precipitates calcium sulphate. Approximately 0.4 tonnes/day of calcium chloride are required to react with the 0.5 tonnes/day sodium sulphate and will produce approximately 0.5 tonnes/day of calcium sulphate which must be separated and disposed of.

To ensure favourable reaction conditions an excess of calcium chloride over that required for reaction with the sodium sulphate is required. Typically this excess would amount to 0.2 tonnes/day of calcium chloride. This must be removed, to the extent practical, by reaction with sodium carbonate to minimize the introduction of calcium into the electrolytic cells. The sodium carbonate required is approximately 0.2 tonnes/day and will produce approximately 0.2 tonnes/day of calcium carbonate which must also be separated and disposed of.

The reaction of barium (as, for example, barium chloride) with sodium sulphate precipitates barium sulphate. Approximately 0.45 tonnes of barium chloride are required to react with 0.5 tonnes sodium sulphate and 0.8 tonnes of barium sulphate are produced. In addition, under the alkaline conditions in the liquor the sodium dichromate present in the electrolyte is converted to sodium chromate. This sodium chromate reacts with the barium chloride to precipitate barium chromate. Typically the stream to be reacted with barium chloride would contain 0.125 tonnes/day of sodium chromate. This sodium chromate would react with 0.16 tonnes/day of barium chloride to produce 0.25 tonnes/day barium chromate which must also be disposed of.

In order that the invention may be better understood a preferred embodiment will now be described by way of example only, with reference to the accompanying drawing wherein the FIGURE shows a schematic flow sheet of an electrolytic process for the continuous production of sodium chlorate according to the invention.

In the flow sheet of the FIGURE, sodium chloride brine containing Ca , Mg and $SO_4^=$ contaminant ions is introduced via line 11 to chemical purification tank 12 to which is added sodium hydroxide and sodium carbonate to effect precipitation of calcium carbonate and magnesium hydroxide which is removed by filtration. The treated brine flows via line 13 to ion exchange column 14 where remaining Ca and Mg ions are removed to a concentration of less than 50 parts per billion. The purified brine flows via line 15 to cells 16 where the pH is adjusted by acid addition and a portion of the chloride content is converted to chlorate. The cell liquor flows via line 17 to a primary flash crystallizer 18 operating under vacuum in which the liquor flash-cools to ca. 20° C. and substantially pure sodium chlorate is crystallized. The crystals of sodium chlorate are removed and a major portion of the mother liquor is recycled to cells 16 via line 19. A minor portion of the mother liquor is fed via line 20, through heat exchanger 21 to chiller secondary crystallizer 22 wherein the mother liquor is further cooled to a selected temperature to effect dual crystallization of sodium sulphate and sodium chlorate admixture. Spent mother liquor from secondary crystallizer 22 is also recycled to cells 16, via heat exchanger 21 in order to pre-chill minor portion of mother liquor in line 20. The crystal admixture is collected. Fresh brine feed is continuously fed to cells 16 as make-up material, via line 15.

EXAMPLE 1

The process as outlined in the flow sheet of the FIGURE is operated in a sodium chlorate plant designed to produce 100 tonnes of sodium chlorate per day from sodium chloride salt containing 1% soluble sulphate as sodium sulphate. It is desired to maintain a steady-state concentration of sodium sulphate in the electrolytic liquor of 20 grams per liter.

The salt is dissolved in water and treated chemically in tank 12 to precipitate calcium and magnesium compounds, and then further purified by ion exchange in column 14 to reduce calcium and magnesium to a concentration less than 50 parts per billion. This purified brine is electrolyzed to obtain liquor from electrolytic cells 16 consisting of 620 g/L $NaClO_3$, 110 g/L NaCl and 20 g/L $Na_2SO_4$ at 60° C.

The electrolytic liquor from cells 16 is introduced into crystallizing vessel 18 which operates under vacuum and in which the liquor flash cools to 20° C. and pure sodium chlorate is crystallized. The quantity of sodium chlorate so crystallized is 95.4 tonnes per day.

The mother liquor from this crystallizer contains 520 g/L $NaClO_3$, 130 g/L NaCl, 30 g/L $Na_2SO_4$. A major portion of this mother liquor is recycled directly to the electrolytic system. A sidestream of a minor portion of this mother liquor is further cooled to ca. −5° C. in separate secondary crystallizer 22. In this vessel 0.55 tonnes per day of $Na_2SO_4$ is crystallized, together with 4.6 tonnes per day of $NaClO_3$.

The production of crystal $NaClO_3$ is thus 95.4 tonnes per day (pure)+4.6 tonnes per day (admixed with $Na_2SO_4$)=100 tonnes per day.

The admixture of $Na_2SO_4$ crystal and $NaClO_3$ crystal produced in secondary crystallizer 22 contains approximately 11% of $Na_2SO_4$. If this admixture is added to the $NaClO_3$ crystal produced in crystallizing vessel 18, the resultant mixture will comprise a total of 100.55 tonnes per day averaging 99.45% $NaClO_3$ and 0.55% $Na_2SO_4$.

In the case of a process relying upon a purge of electrolytic liquor to remove $Na_2SO_4$ and maintain the steady-state concentration of $Na_2SO_4$ in the electrolytic liquor at 20 grams per liter, it will be evident, firstly, that the amount of NaCl (and hence $Na_2SO_4$) required to be fed into the process is increased, because NaCl is also present in the purge liquor, and, secondly, that the required rate of purge liquor, and thus of $NaClO_3$ in solution, will be determined by the concentration of sulphate in the feed salt and the composition of the purge liquor. Thus, if the purge liquor is taken from the electrolytic liquor stream, having the composition 620 g/L $NaClO_3$, 110 g/L NaCl and 20 g/L $Na_2SO_4$, the purge liquor stream will contain 18 tonnes per day of $NaClO_3$, 3.2 tonnes per day of NaCl, and 0.55 tonnes per day $Na_2SO_4$, and will have a total volume of approximately 30 cubic meters per day. Thus, only 82 tonnes per day may be produced as crystal $NaClO_3$ in the crystallizer, and 30 cubic meters per day of liquid product, containing 18 tonnes per day of $NaClO_3$, must be co-produced, and this liquid product will contain $Na_2SO_4$ in the ratio of 3.2% to the $NaClO_3$. Furthermore, if sodium dichromate is maintained at a typical concentration of 4 g/L in the electrolytic liquor, the purge will contain 0.12 tonnes per day of sodium dichromate.

In summary, therefore, if sulphate concentration is controlled by liquor purge, although the plant produces a total of 100 tonnes per day of $NaClO_3$, 18 tonnes per day must be purged as liquor, leaving only 82 tonnes per day to be produced as crystal. In addition, raw material consumption of the process are increased, since an additional 3.2 tonnes per day of NaCl and 0.12 tonnes per day of $Na_2Cr_2O_7$ must be provided to make up for the NaCl and $Na_2Cr_2O_7$ leaving in the purge stream.

Table 1 gives the concentrations of sodium chlorate, sodium chloride and sodium sulphate for a number of typical mother liquors at various temperatures. This Table shows that there is an absolute and relatively sudden decrease of sodium sulphate solubility in the mother liquor on cooling to −7° C.

TABLE I

| Temperature | $NaClO_3$(%) | NaCl(%) | $Na_2SO_4$(%) |
|---|---|---|---|
| 60° C. | 34.7 | 11.1 | 2.1 |
| | 36.2 | 9.1 | 2.1 |
| | 37.0 | 7.5 | 2.1 |
| 20° C. | 31.2 | 12.0 | 2.2 |
| | 31.9 | 11.7 | 2.2 |
| | 32.8 | 10.0 | 2.2 |
| | 33.9 | 9.5 | 2.1 |
| | 37.3 | 6.2 | 2.1 |
| 10° C. | 32.2 | 10.0 | 2.1 |
| | 33.8 | 8.0 | 2.1 |
| | 38.2 | 5.7 | 2.1 |
| 4° C. | — | — | 1.25 |
| 0° C. | — | — | 1.05 |
| −3° C. | — | — | 0.83 |
| −5° C. | — | — | 0.70 |
| −7° C. | 32.3 | 9.0 | 0.55 |
| | 34.3 | 6.6 | 0.45 |

Since the admixture is essentially free of chromium compounds it may be treated with a barium salt to precipitate $BaSO_4$ which can be removed for example by filtration or settling, and the clear chlorate solution returned to the process. As disclosed hereinabove, chlorate electrolytic liquors contain dichromate, and barium ion will precipitate $BaCrO_4$ as well as $BaSO_4$ unless the pH is made low and carefully controlled. The process of the present invention affords the opportunity for the precipitation of chromium compounds to be avoided, resulting in less sludge for disposal, a chromium free sludge which is more environmentally acceptable, a reduction in barium ion consumption, and no removal of chromium from the system, which would otherwise have to be replaced.

Accordingly, the invention further provides a process as hereinbefore defined wherein said admixture of sodium sulphate and sodium chlorate is dissolved in water and treated with a barium compound to effect precipitation of barium sulphate, removing said barium sulphate and recycling resultant solution to said electrolytic process.

Alternatively, the mixture of chlorate and sulphate solids from the secondary chiller crystallizer may be added to the chlorate solids from the main crystallizer ahead of the usually present hot air dryer, and the dryer operated in such a way as to favour carryover of sulphate solids, in addition to chlorate fines, into the wet dust scrubber. The dustscrubber liquid can then be treated for sulphate removal as outlined above, with similar advantages.

Table II shows, for a plant producing 100 tonnes/day of $NaClO_3$ under the same set of operating conditions as for Example I, the effect of sulphate concentration in the feed salt upon the distribution of products and salt and dichromate requirements, for the prior art process using liquor purge to control sulphate concentration in the electrolytic liquor (A) and the process according to this invention, wherein crystallization of sodium sulphate in a chiller secondary crystallizer is used to control sulphate concentration in the electrolytic liquor (B).

In Table II, Columns A(1) and B(1) show various sulphate concentrations in the feed salt. Column A(2) shows the amount of $NaClO_3$ which must be removed in solution as purged liquor, and Column A(3) shows the amount of $NaClO_3$ which can be produced as crystal. Column A(4)shows the total amount of NaCl which must be fed to the process to satisfy the crystal and liquor purge demands. Column A(5 ) shows the amount of sodium dichromate which will leave the process with the liquor purge, and thus must be added to the process. The increasing restriction to the proportion of $NaClO_3$ which may be produced as crystal, and the increasing requirement for NaCl and sodium dichromate, as the concentration of sulphate in the salt increases, will be evident.

In Table II, Column B(2) shows the amounts of crystalline $NaClO_3$ and $Na_2SO_4$ which will be produced in the secondary chiller crystallizer. Column B(3) shows the amount of $NaClO_3$ crystal which will be produced in the primary crystallizer. Columns B(4), B(5), B(6) show that total $NaClO_3$ crystal produced remains at 100 tonnes/day, NaCl requirement remains at the minimum of 55 tonnes/day, and sodium dichromate make up requirement remains at zero, regardless of the concentration of sulphate in the feed salt.

By comparison of Sections B and A of Table II, the advantages of the process according to this invention over the prior art processes are evident, and in particular, the increasing advantages with salts containing increasing amounts of sulphate impurity, is made clear.

TABLE II

A. Sulfate Removal By Liquor Purge Only

| (1) $SO_4$ as $Na_2SO_4$ in Salt - % | (2) $NaClO_3$ in Purge - tonne/day | (3) $NaClO_3$ as Crystal - tonne/day | (4) Total NaCl Input - tonne/day | (5) Dichromate Make-up - tonne/day |
|---|---|---|---|---|
| 0 | 0 | 100 | 55.0 | 0 |
| 0.2 | 3.5 | 96.5 | 55.6 | 0.02 |
| 0.5 | 8.8 | 91.2 | 56.6 | 0.06 |
| 1.0 | 18.0 | 82.0 | 58.2 | 0.12 |
| 2.0 | 38.3 | 61.7 | 61.8 | 0.25 |
| 3.0 | 61.3 | 38.7 | 65.9 | 0.40 |

B. Sulfate Removal By Secondary Chiller Crystallizer Only

| (1) $SO_4$ as $Na_2SO_4$ in Salt - % | (2) Secondary Crystal $NaClO_3/Na_2SO_4$ - tonne/day | | (3) $NaClO_3$ in Primary Crystal - tonne/day | (4) Total $NaClO_3$ as Crystal - tonne/day | (5) Total NaCl Input - tonne/day | (6) Dichromate Make-Up - tonne/day |
|---|---|---|---|---|---|---|
| 0 | 0 | 0 | 100 | 100 | 55 | 0 |
| 0.2 | 1.2 | 0.11 | 98.8 | 100 | 55 | 0 |
| 0.5 | 2.3 | 0.28 | 97.7 | 100 | 55 | 0 |
| 1.0 | 4.6 | 0.55 | 95.4 | 100 | 55 | 0 |
| 2.0 | 8.8 | 1.10 | 91.2 | 100 | 55 | 0 |
| 3.0 | 12.6 | 1.65 | 87.4 | 100 | 55 | 0 |

Thus, the invention provides a continuous process for the production of sodium chlorate having the following advantages:

(i) The process provides a continuous method of producing the total production of sodium chlorate from a sodium chlorate plant as crystal using salt containing sulphate without the need for a liquor purge or chemical treatment.

(ii) As no liquor purge is required the quantity of sodium chloride to be purified is reduced and no make-up of sodium dichromate is required.

(iii) The production of chemical sludges from treatment with calcium or barium compounds to precipitate sulphate may be eliminated. The associated capital cost for reaction and separation of the sludges and operating costs for chemicals, manpower and sludge disposal may be eliminated.

(iv) The sulphate impurity in the raw salt is removed from the plant in the form of sodium sulphate mixed with the sodium chlorate. This sodium sulphate is, optionally, eventually used by the consumer to replace sulphur lost from the consumers process and is, therefore, of economic value.

(v) The admixture from secondary chilling may be dried and combined with dry crystal or may be shipped with residual moisture from those plants designed on this basis.

(vi) If a sulphate-free sodium chlorate crystal product is desired the sodium chlorate/sodium sulphate co-crystallized from the secondary chilling step may be dissolved in water and chemically treated. Since the resulting liquor will be essentially free of sodium dichromate or chromate only that quantity of barium compounds required for reaction with sulphate will be required, reducing the chemical consumption. If calcium compounds are used the quantity required is reduced as the high concentration of sulphate in the liquor after solutioning minimizes the excess calcium that must be added to ensure favourable reaction conditions.

(vii) No calcium or barium compounds need be introduced into the process, both of which may be detrimental to the operation of the electrolytic cell.

(viii) The process reduces the operating costs of a sodium chlorate crystal facility.

(ix) The purchase price of salt depends, to a degree, on the impurities present in the salt. The process allows sodium chloride containing a high quantity of sulphate to be used with resulting savings in raw material cost.

We claim:

1. An improved continuous process for the production of sodium chlorate by the electrolysis of sodium chloride in an electrolytic process comprising:

(a) feeding water and sodium chloride contaminated with sulphate to a reaction zone wherein said sodium chloride is electrolyzed to chlorine and sodium hydroxide, said chlorine and sodium hydroxide is reacted to form sodium hypochlorite which is then reacted to produce a sodium chlorate rich liquor;

(b) cooling said sodium chlorate rich liquor to crystallize out a portion of said sodium chlorate to provide crystals of sodium chlorate and a mother liquor comprising sodium chlorate, sodium chloride and sulphate;

(c) removing said crystals of sodium chlorate;

wherein the improvement comprises:

(d) recycling a major portion of said mother liquor to said reaction zone;

(e) cooling a minor portion of said mother liquor to a temperature to effect crystallization therefrom of a portion of said sulphate as sodium sulphate in admixture with said sodium chlorate, and production of a cold saturated solution of spent mother liquor;

(f) removing said crystallized admixture from said spent mother liquor;

(g) recycling said spent mother liquor to said reaction zone; and wherein the amount of said minor portion of said mother liquor is selected such that the sulphate concentration in said reaction zone is maintained substantially constant at a predetermined level.

2. A process as claimed in claim 1 wherein said minor portion of mother liquor is cooled to a temperature of about 5° C. or below.

3. A process as claimed in claim 2 wherein said minor portion of mother liquor is cooled to a temperature of about −5° C.

4. A process as claimed in claim 1 wherein said minor portion of said mother liquor is cooled to such a temperature as to effect said crystallization of a portion of said sulphate as sodium sulphate in admixture with said sodium chlorate such that the concentration of sulphate remaining in said cold saturated spent mother liquor does not exceed 10 g/liter considered as sodium sulphate.

5. A process as claimed in claim 4 wherein said concentration of sulphate remaining in said cold saturated spent mother liquor does not exceed 7 g/liter considered as sodium sulphate.

6. A process as claimed in any of claims 1 to 5 wherein the concentration of sulphate in the electrolytic system does not exceed 30 g/liter considered as sodium sulphate.

7. A process as claimed in any one of claims 1 to 5 wherein said admixture of sodium sulphate and sodium chlorate is dissolved in water and treated with a barium or calcium solution to effect precipitation of sulphate, the precipated sulfate is removed and the resultant solution is recycled to said electrolytic process.

* * * * *